United States Patent [19]

Rich

[11] Patent Number: 4,501,080

[45] Date of Patent: Feb. 26, 1985

[54] WORKPIECE STAND

[76] Inventor: Homer C. Rich, 1100 S. Noland Rd., Independence, Mo. 64050

[21] Appl. No.: 529,139

[22] Filed: Sep. 2, 1983

[51] Int. Cl.[3] ..... D06C 3/08

[52] U.S. Cl. ..... 38/102.7; 223/120; 248/181; 269/152

[58] Field of Search ..... 223/120; 38/102.1, 102.2, 38/102.3, 102.4, 102.5, 102.7; 248/176, 178, 181; 269/906, 43, 152, 909

[56] References Cited

U.S. PATENT DOCUMENTS

| | | | |
|---|---|---|---|
| 699,263 | 5/1902 | Vosler . | |
| 707,353 | 8/1902 | Post . | |
| 807,857 | 12/1905 | Palmenberg . | |
| 1,829,964 | 11/1931 | Randall | 248/181 X |
| 3,855,718 | 12/1974 | Parsons et al. . | |
| 4,175,343 | 11/1979 | Mathews . | |

FOREIGN PATENT DOCUMENTS

| | | | |
|---|---|---|---|
| 283665 | 3/1931 | Italy | 248/181 |
| 278515 | 10/1927 | United Kingdom | 248/181 |
| 459068 | 1/1936 | United Kingdom | 248/181 |

*Primary Examiner*—Werner H. Schroeder
*Assistant Examiner*—Andrew M. Falik
*Attorney, Agent, or Firm*—Litman, Day & McMahon

[57] ABSTRACT

A workpiece stand including a base and an upright standard with a lower end attached to the base and an upper end. A universal joint assembly is mounted on the standard upper end and includes a tension spring and first and second mechanisms for adjusting the tension of the tension spring. A cross arm is connected at its middle to the universal joint assembly and includes opposite ends. A pair of clamp assemblies are attached to the cross arm at its opposite ends. The clamp assemblies are adapted for securing a frame for a workpiece.

10 Claims, 3 Drawing Figures

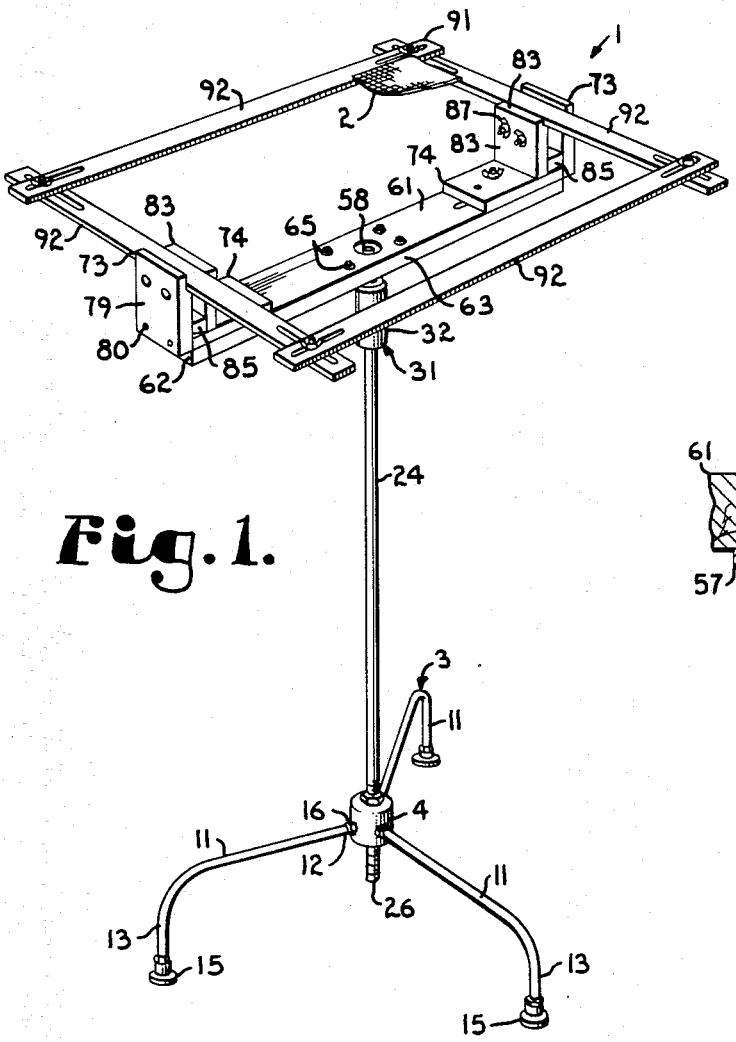
Fig. 1.
Fig. 2.
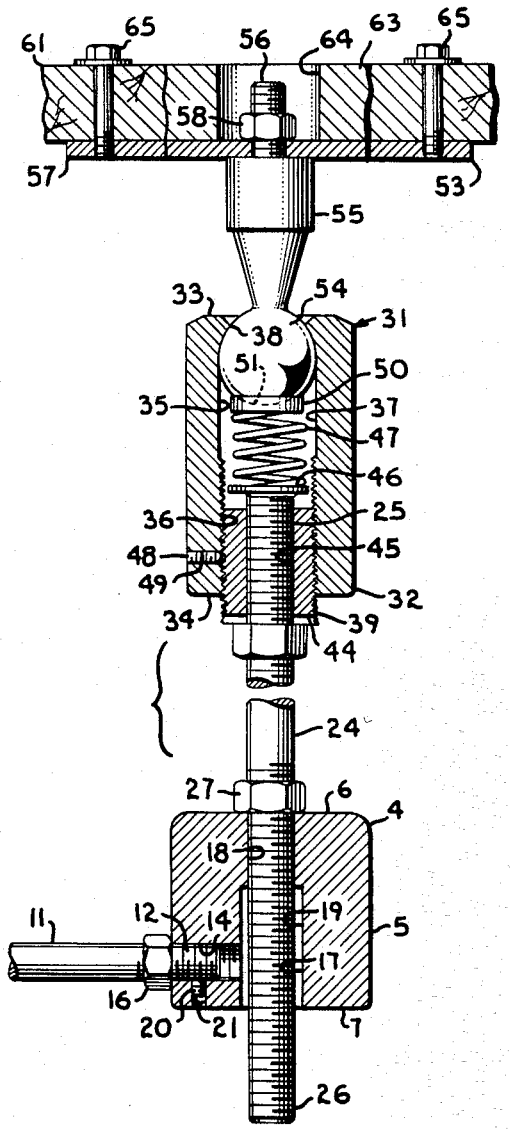
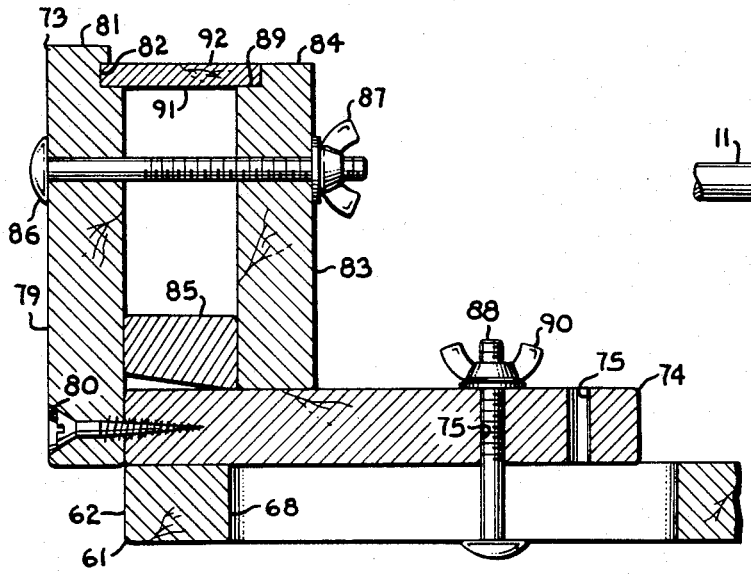
Fig. 3.

WORKPIECE STAND

BACKGROUND OF THE INVENTION

1. Field of the Invention

The present invention relates generally to workpiece stands and in particular to an adjustable stand for a stretcher frame and the like.

2. Description of the Prior Art

A variety of stands have heretofore been developed for supporting workpieces such as stretcher frames, embroidery hoops and the like in predetermined positions. One such stand is exemplified by the Vosler U.S. Pat. No. 699,263 for an embroidery frame adapted for attachment to a chair, table or bedside rail. The embroidery frame is mounted on a bow which is pivotable with respect to two axes for positioning.

Another type of embroidery frame holder is shown in the Post U.S. Pat. No. 707,353 and includes an arm movably mounted on a clamp mechanism by a ball and socket-type universal joint. Yet another type of workpiece stand for embroidery frames and the like is exemplified by Parsons et al., which show a floor stand with a base plate, a pole and support strips connected to the pole upper end by a universal joint.

However, heretofore there has not been available a stand for workpieces with the adjustability of the present invention or its flexibility for accommodating various types of workpieces.

SUMMARY OF THE INVENTION

In the practice of the present invention, a workpiece stand is provided which includes a base having a base cylinder and a plurality of legs extending radially outwardly therefrom. A standard receiver extends through the base cylinder. A standard includes a lower end threadably received in the standard receiver and an upper end. A universal joint assembly is mounted on the standard upper end and includes a tension spring and independent first and second mechanisms for adjusting the tension of said tension spring. The universal joint assembly also includes a casing and a mounting bracket having a ball end positioned within the casing and engaged by the tension spring. A cross arm is mounted on the mounting bracket and includes clamp assemblies at its opposite ends for securing a stretcher frame and the like for a workpiece.

The principal objects of the present invention are: to provide a workpiece stand for embroidery hoops, stretcher frames and the like; to provide such a stand which is adapted for supporting a variety of workpieces; to provide such a stand which includes a base for floor mounting; to provide such a stand which includes a universal joint for adjustably positioning a workpiece; to provide such a stand which is adapted for height adjustment; to provide such a stand which includes independent means for adjusting the resistance to movement of the universal joint; to provide such a stand which is adapted for providing a stable support for a workpiece; to provide such a stand which allows a user relatively free access to the workpiece; to provide such a stand with clamps for mounting a stretcher frame, embroidery hoops and the like thereon; to provide such a stand wherein the spacing between the clamps is adjustable; and to provide such a stand which is economical to manufacture, efficient in operation, capable of a long operating life, and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of a workpiece stand embodying the present invention.

FIG. 2 is an enlarged, fragmentary, cross-sectional view of the stand.

FIG. 3 is an enlarged, fragmentary, cross-sectional view of the stand particularly showing a clamp.

DETAILED DESCRIPTION OF THE INVENTION

Referring to the drawings in more detail, the reference numeral 1 generally designates a stand for a workpiece 2 comprising, for example, needlework, embroidery, a quilt or the like. The stand 1 comprises a base 3 with a base cylinder 4 having an outer surface 5 and upper and lower ends 6, 7. Three legs 11 extend radially outwardly from the base cylinder outer surface 5 at approximately 60 degree intervals and include proximate and distal ends 12, 13. The leg proximate ends are threadably received in leg receivers 14 in the base cylinder 4. Leg proximate end lock nuts 16 secure respective leg proximate ends 12 in their respective leg receivers 14. The leg proximate ends 12 are further secured within their respective receivers 14 by leg set screws 20 threadably received within leg set screw receivers 21. The legs 11 are bent so that their distal ends 13 are positioned below the leg proximate ends 12 and are vertically oriented. Feet 15 are mounted on the leg distal ends 13.

A standard receiver 17 extends through the base cylinder 4 between its upper and lower ends 6 and 7 and includes respective upper and lower threaded and unthreaded portions 18, 19. An upright standard 24 comprises a steel rod with threaded upper and lower ends 25, 26. The standard lower end 26 is threadably received in the standard receiver threaded portion 18 and secured therein by a standard lower end lock nut 27.

A universal joint assembly 31 is mounted on the standard upper end 25 and includes a casing 32 with upper and lower ends 33, 34. A casing bore 35 extends through the casing 32 between its upper and lower ends 33, 34 and includes a lower, threaded portion 36 and an upper, unthreaded portion 37. A lip 38 restricts the diameter of the casing bore 35 adjacent the casing upper end 33. A screw plug 41 is threadably received within the casing bore threaded portion 36 and includes upper and lower ends 42, 43. A slot 44 extends diametrically across screw plug lower end 43 and a threaded screw plug bore 45 extends between the screw plug upper and lower ends 42, 43 for threadably receiving the standard upper end 25.

A washer 46 engages the standard upper end 25 within the casing bore 35. A helical tension spring 47 is placed on top of the washer 46 within the casing bore 35 and engages a cup washer 50 with an upwardly open depression 51. A set screw 48 engages the screw plug 41 and is threadably reciprocable within a universal joint set screw receiver 49 communicating with the casing bore 35.

The universal joint assembly 31 further comprises a mounting bracket 53 with a ball lower end 54 received within the casing bore unthreaded portion 37 and restrained by the lip 38. The ball end 54 slidably engages the cup washer 50 within its depression 51. The mounting bracket 53 also includes a shank 55 extending from the ball end 54 and terminating at a threaded stud 56. A plate 57 is secured to the shank 55 by a nut 58 threadably received on the threaded stud 56.

A cross arm 61 with opposite ends 62 and a middle 63 is mounted on the standard 24 by the universal joint assembly 31. The mounting bracket threaded stud 56 and the nut 58 are positioned within an opening 64 in the cross arm middle 63. A plurality of cross arm mounting bolts 65 extend through the cross arm 61 and are threadably received in the plate 57. A respective elongated slot 68 extends through the cross arm 61 at each opposite end 62 thereof in alignment with the cross arm 61.

A respective clamp assembly 73 is mounted on each cross arm opposite end 62. Each clamp assembly 73 includes a base plate 74 with a pair of apertures 75. A pair of outer clamp uprights 79 are attached to each base plate 74 by wood screws 80. Each outer clamp upright 79 includes a respective upper edge 81 and an inwardly open groove 82 positioned slightly below the upper edge 81. A respective inner clamp upright 83 is place on each base plate 74 in approximately parallel, space relation relative to a respective outer clamp upright 79 and includes an upper edge 84 with a dado 89. A pair of spacer blocks 85 are each placed between an adjacent pair of clamp uprights 79, 83. The clamp uprights 79, 83 are drawn together by respective carriage bolts 86 receiving wing nuts 87.

The clamp assemblies 73 are each mounted on a respective cross arm opposite end 62 by a respective carriage bolt 88 and wing nut 90 received in a respective elongated slot 68 and aperture 75. With the clamp assemblies 73 properly positioned, they may be secured by tightening the wing nuts 90. Longitudinal adjustment of the clamp assembly 73 positions is provied by the elongated slots 68 and the pairs of apertures 75 each adapted for receiving a respective carriage bolt 88. A stretcher frame 91 including four slats 92 interconnected in a rectilinear configuration is mounted on the clamp assemblies 73. The outer edges of an opposite pair of slats 92 are captured within the grooves 82 whereby movement of the universal joint assembly 31 may be affected by a person grasping the stretcher frame 91. Since a pair of the slats 92 are captured by the outer clamp uprights 79 as described above, the stretcher frame 91 is prevented from becoming disengaged from the clamp assemblies 73. The workpiece 2 is secured to the stretcher frame 91 in a well-known conventional manner.

In operation, the stand 1 is assembled by inserting the leg proximate ends 12 into their respective receivers 14 and inserting the standard lower end 11 into the standard receiver 17. The tension spring 47 and the washer 46 are placed within the casing bore 35 and the screw plug 41 is advanced into the casing 32 until the tension spring 47 lightly holds the ball end 54 against the casing lip 38. The set screw 48 in then advanced into its receiver 49 until it tightly engages the screw plug 41 whereby rotation thereof is prevented.

Preferably, the fine adjustment of the tension spring 47 is made by means of the standard 24 after the cross arm 61 is mounted. Otherwise, it is difficult to determine the desired amount of resistance to movement in the universal joint assembly 31 because with the cross arm 61 in place, a much greater leverage arm is provided for moving the universal joint assembly 31. However, the screw plug 41 functions to retain the tension spring 47 and the washer 46 within the casing bore 35 to prevent them from being ejected. Therefore, the locking screw plug 41 functions as a safety feature for preventing injury to a user resulting from the ejection of the spring 47 and the washer 46. In the event the desired tension cannot be achieved by rotating the casing 32 with respect to the standard 24, the screw plug 41 may be inwardly or outwardly advanced to a position whereat the desired tension in the spring 47 may be achieved.

Although the workpiece 2 comprises a stretcher frame 91, it is anticipated that interlocking embroidery hoops (not shown) may be supported on the stand 1 of the present invention. In order to accommodate such a frame, different clamps may be provided and the spacing therebetween altered to suit the particular requirements of different embroidery hoops.

The height of the workpiece 2 may be adjusted by rotating the base cylinder 4 with respect to the standard 24. The user then adopts a seated or other position next to the stand 1, grasps the cross arm 61 and places the workpiece 2 in a desired position. The stand 1 is designed in such a way to avoid interference with a user and to be comfortable for use from almost any position, seated or otherwise.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

It is to be understood that while certain forms of the present invention have been illustrated and described herein, it is not to be limited to the specific forms or arrangement of parts described and shown.

What is claimed and desired to be secured by Letters Patent is as follows:

1. A workpiece stand, which comprises:

(a) a base including:

(1) a base cylinder with upper and lower ends and a standard receiver extending therebetween, said standard receiver including a threaded portion; and (2) a plurality of legs extending radially outwardly from said base cylinder;

(b) a standard including threaded upper and lower ends, said standard lower end being threadably received in said standard receiver;

(c) a universal joint assembly including:

(1) a casing with upper and lower ends;

(2) a casing bore extending between said casing upper and lower ends and including a threaded portion and a lip restricting the diameter of said bore adjacent said casing upper end;

(3) a screw plug threadably received in said casing bore threaded portion, said screw plug having a threaded screw plug receiver extending therethrough and adapted to receive said standard upper end;

(4) a spring positioned in said casing bore and engaging said standard upper end;

(5) a mounting bracket having a ball end positioned within said casing bore and urged by said spring against said lip, a shank attached to and extending from said ball end and a plate mounted on said shank;

(d) a cross arm with opposite ends and a middle attached to said mounting bracket plate; and (e) a pair of clamps each attached to a respective cross arm opposite end, each said clamp including:

(1) a clamp base plate mounted on said cross arm opposite end and longitudinally movable relative thereto;

(2) an outer clamp upright connectd to said base plate;

(3) an inner clamp upright positioned in spaced relation with respect to said outer clamp upright;

(4) a spacer positioned between and engaging said clamp uprights; and (5) connector means enagaging said uprights and adapted for drawing said uprights together.

2. A workpiece stand, which comprises:

(a) base means;

(b) an upright standard having a lower end attached to said base means and an upper end;

(c) a universal joint assembly attached to said standard upper end;

(d) a cross arm having a middle connected to said universal joint assembly and opposite ends; and (e) a pair of clamp assemblies each mounted on a respective cross arm opposite end and including:

(1) a base plate connected to said cross arm and longitudinally movable with respect thereto;

(2) an outer clamp upright extending upwardly from said base plate;

(3) an inner clamp upright positioned in spaced relation from said outer clamp upright;

(4) a spacer positioned between said uprights; and (5) connector means interconnecting said uprights and adapted for drawing said uprights together.

3. A stand according to claim 2 wherein:

(a) said outer clamp upright includes a groove adapted for capturing a workpiece.

4. The stand according to claim 3 wherein:

(a) said inner clamp includes an upper edge and a dado at said upper edge.

5. The stand according to claim 4 which includes:

(a) a frame adapted for mounting a workpiece on, said frame including an opposite pair of slats each secured by a respective clamp assembly.

6. The stand according to claim 5 which includes:

(a) each said slat being captured in a respective groove and a respective dado.

7. A workpiece stand, which comprises:

(a) base means;

(b) a standard including upper and lower ends, said upper end being threaded and said lower end being attached to said base means;

(c) a universal joint assembly including:

(1) a casing with upper and lower ends;

(2) a casing bore extending between said casing upper and lower ends and including a threaded portion and a lip restricting the diameter of the bore adjacent the casing upper end;

(3) a screw plug threadably recieved in said casing bore threaded portion, said screw plug having a threaded screw plug receiver extending therethrough and adapted to threadably receive said standard upper end;

(4) a compressed spring positioned in said casing bore and engaging said standard upper end; and (5) a mounting bracket having a ball end positioned within said casing bore and urged by said spring against said lip and a shank attached to and extending from said ball end;

(d) a cross arm connected to said mounting bracket shank;

(e) clamp means mounted on said cross arm;

(f) said threaded engagement between said screw plug and said casing bore threaded portion comprising first tension means for adjusting the tension in said spring; and (g) said threaded connection between said plug receiver and said standard upper end comprising second tension means for adjusting the tension in said spring.

8. The stand according to claim 7 wherein said universal joint assembly includes:

(a) a cup washer having a depression positioned within said casing bore between said spring and said mounting bracket ball lower end, a portion of said mounting bracket ball lower end being slidably received in said cup washer depression.

9. The workpiece stand according to claim 7, which includes:

(a) a lock nut threadably received on said standard upper end below said screw plug and adapted for tightening against said screw plug whereby relative rotation between said standard and said screw plug is prevented.

10. The workpiece stand according to claim 7, which includes:

(a) a threaded set screw receiver extending through said casing to said threaded portion of said casing bore; and (b) said set screw being threadably received in said set screw receiver and adapted for engaging said screw plug whereby relative rotation between said casing and said screw plug is prevented.

* * * * *